US007816311B2

(12) United States Patent
Feng et al.

(10) Patent No.: US 7,816,311 B2
(45) Date of Patent: Oct. 19, 2010

(54) ERGONOMIC BAR SOAP

(75) Inventors: Feng Feng, Chesterfield, MO (US); David Kusch, St. Louis, MO (US); Jonathan Sundy, St. Louis, MO (US); Marc Hunter, St. Louis, MO (US); Bryce Rutter, St. Louis, MO (US); Robert Dail, Phoenix, AZ (US)

(73) Assignee: The Dial Corporation, Scottsdale, AZ (US)

( * ) Notice: Subject to any disclaimer, the term of this patent is extended or adjusted under 35 U.S.C. 154(b) by 238 days.

(21) Appl. No.: 12/011,674

(22) Filed: Jan. 29, 2008

(65) Prior Publication Data

US 2009/0192070 A1 Jul. 30, 2009

(51) Int. Cl.
*A16K 7/00* (2006.01)

(52) U.S. Cl. ..... 510/141; 510/148; 510/152

(58) Field of Classification Search ..... 510/141
See application file for complete search history.

(56) References Cited

U.S. PATENT DOCUMENTS 7,428,965 B2 * 9/2008 Johnson et al. ..... 206/77.1

* cited by examiner

*Primary Examiner*—Necholus Ogden, Jr.
(74) *Attorney, Agent, or Firm*—David K. Benson

(57) ABSTRACT

A cleansing bar includes a surfactant-containing body, which includes a top surface, a bottom surface that is substantially opposite to the top surface, first and second ends, and first and second sides extending horizontally and meeting at the first and second ends to together define a perimeter around the cleansing bar between the top and bottom surfaces. A first horizontally-extending groove is formed in at least the first side surface. According to one embodiment, the first horizontally-extending groove extends only partially between the first and second ends. A second horizontally-extending groove is formed in the second side surface, and also extends only partially between the first and second ends. According to another embodiment, the first horizontally-extending groove is further formed around the first and second ends and in the second side surface to encircle the cleansing bar.

11 Claims, 7 Drawing Sheets

ERGONOMIC BAR SOAP

FIELD OF INVENTION

The present invention is directed to a cleansing bar. More particularly, the present invention is directed to an ergonomically shaped cleansing bar that has improved grip ability.

BACKGROUND

Cleansing bars, including personal soap bars, laundry soap bars, and various scrubbing bars typically have a somewhat rectangular shape. However, some cleansing bars have a more rounded or oval shape in order to provide visual appeal to consumers. Decorative cleansing bars are also well known. For example, hand cleansing soap bars often are molded and displayed in a wide variety of shapes and sizes to provide a decorative appeal to a sink area in a restroom or other cleansing area.

Cleansing bars are usually sized to be easily graspable using one hand. Thus, a person is able to manipulate the soap using only one hand or the other in order to effectively clean themselves or various objects. Water will dissolve the cleansing bar components during cleansing, and also combines with the components to produce suds. These interactions with water cause the cleansing bars to become slippery and difficult to grasp. Furthermore, the act of tightly grasping a cleansing bar while repeatedly performing a rubbing motion during cleansing can be fatiguing to the hand and forearm muscles, particularly when the cleansing bar becomes slippery and increased strength is necessary to securely grasp the cleansing bar.

There is therefore a need for a cleansing bar that is easily gripped. There is a particular need for a cleansing bar that continues to be easily gripped after it becomes wet and slippery during cleansing.

SUMMARY OF THE INVENTION

This summary of the invention section is intended to introduce the reader to aspects of the invention. Particular aspects of the invention are pointed out in other sections herein below, and the invention is set forth in the appended claims which alone demarcate its scope.

In accordance with an exemplary embodiment of the present invention, a cleansing bar includes a surfactant-containing body, which includes a top surface, a bottom surface that is substantially opposite to the top surface, first and second ends, and first and second sides extending horizontally and meeting at the first and second ends to together define a perimeter around the cleansing bar between the top and bottom surfaces.

A first horizontally-extending groove is formed in at least the first side surface. According to one embodiment, the first horizontally-extending groove extends only partially between the first and second ends. A second horizontally-extending groove is formed in the second side surface, and also extends only partially between the first and second ends. According to another embodiment, the first horizontally-extending groove is further formed around the first and second ends and in the second side surface to encircle the cleansing bar.

DETAILED DESCRIPTION OF THE INVENTION

The detailed description of various exemplary embodiments of the invention herein makes reference to exemplary compositions and methods of process for producing such compositions. While these exemplary embodiments are described in sufficient detail to enable those skilled in the art to practice the invention, it should be understood that other embodiments may be realized, and that logical and processing changes may be made without departing from the spirit and scope of the invention. Thus, the detailed description herein is presented for purposes of illustration only and not of limitation.

As disclosed herein, a cleansing bar includes any bars that include one or more cleansing surfactants, such as soaps and synthetic detergents, which are suitable for cleansing applications. Exemplary cleansing bars include personal soap and/or synthetic detergent bars, laundry soap bars, and various scrubbing bars. Other ingredients including, for example, moisturizers, exfoliants, antibacterial compounds, solvents, fragrances, emollients, non-cleansing surfactants, fillers, and hydrotopes. As will be explained in detail, the general shape of the cleansing bar may not be an important aspect of the present invention since many of the disclosed grip-enhancing features may be included in bars having various shapes and sizes.

Figure 1:
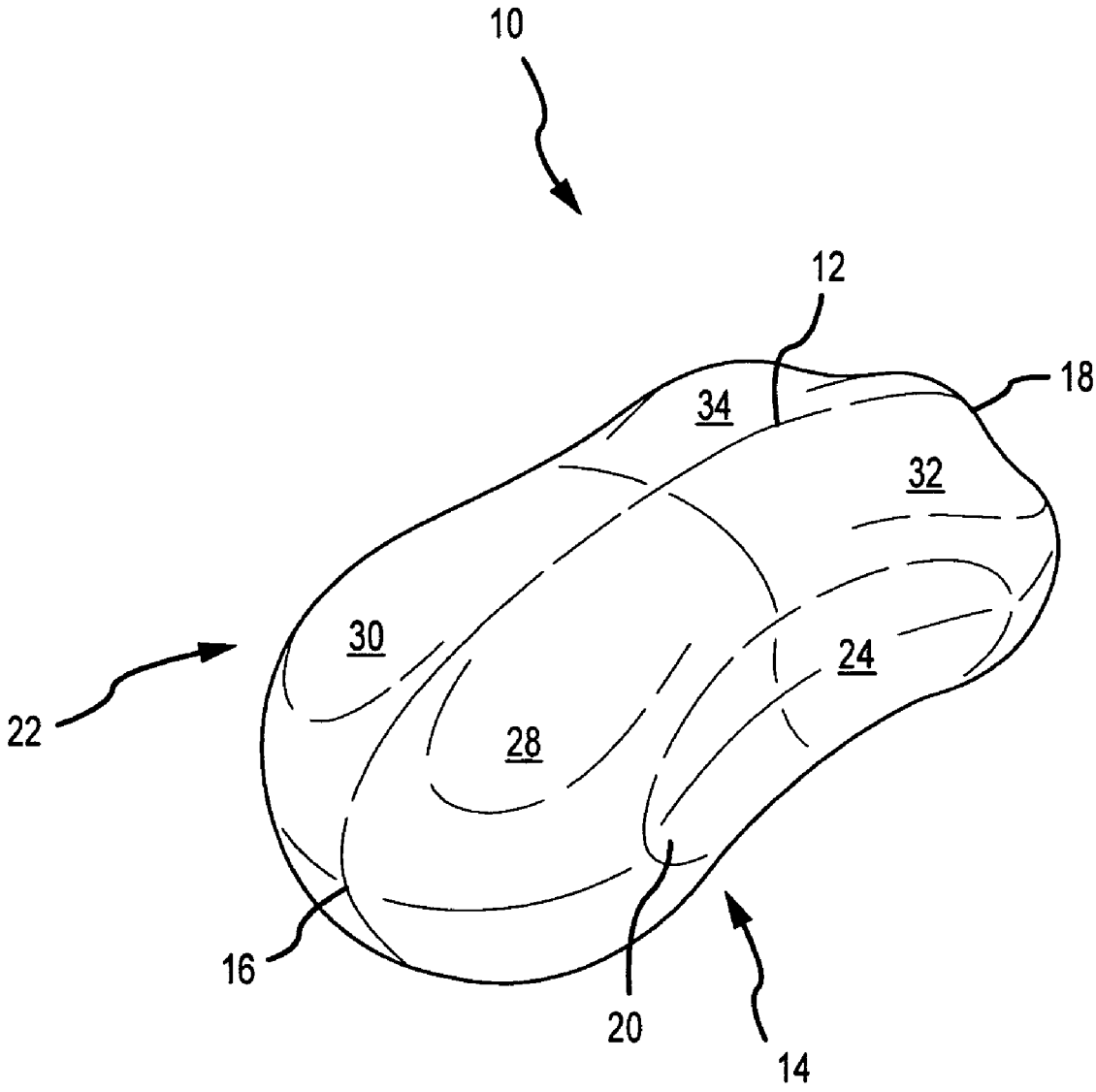
FIG. 1 is a perspective view of one exemplary cleansing bar according to an embodiment of the present invention.
Figures 2A, 2B, 2C:
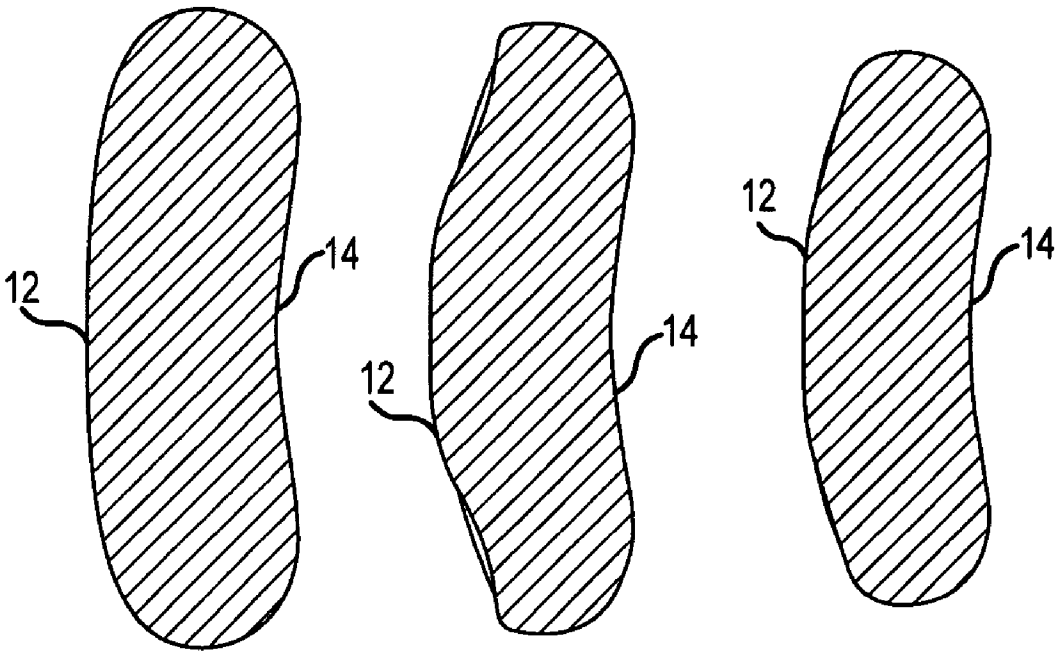
FIG. 2 is a top view of the cleansing bar depicted in FIG. 1, and FIGS. 2A, B, and C are cross-sectional views of the cleansing bar taken along lines A, B, and C drawn in FIG. 2.
Figure 2:
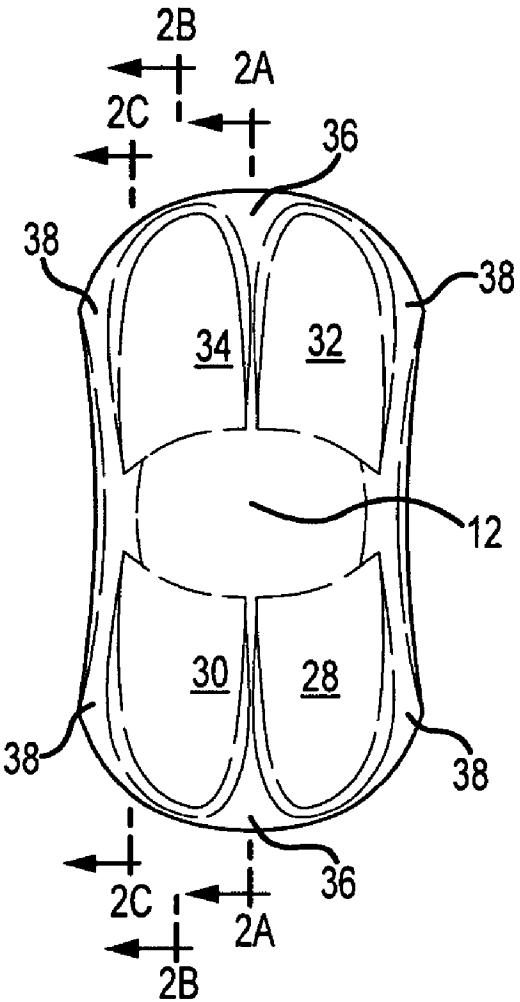
Figure 3A:
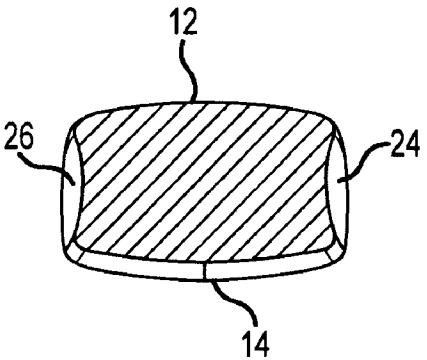
FIG. 3 is a side view of the cleansing bar depicted in FIG. 1, and FIGS. 3A, B, and C are cross-sectional views of the cleaning bar taken along lines A, B, and C drawn in FIG. 3.
Figure 4:
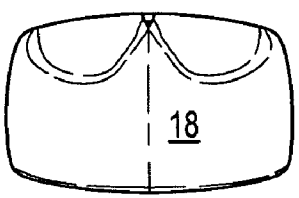
FIG. 4 is a front view of the cleansing bar depicted in FIG. 1.
Figure 3C:
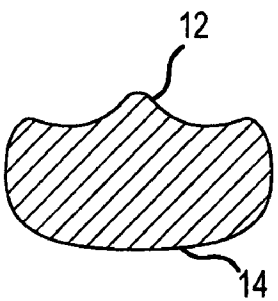
Figure 3:
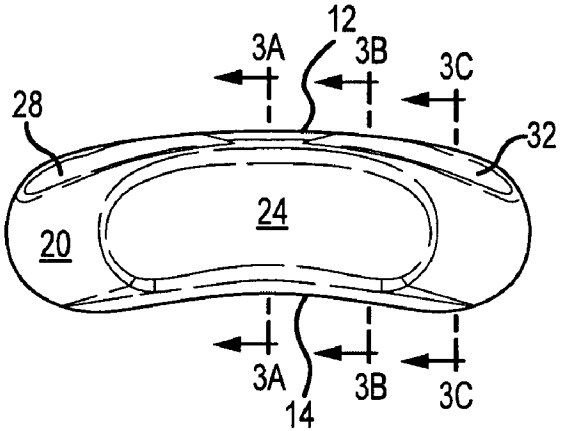
Figure 3B:
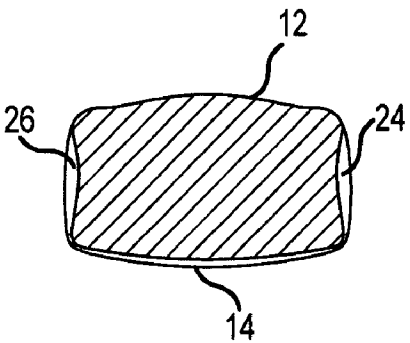

Turning now to FIG. 1, an exemplary cleansing bar 10 according to an embodiment of the present invention is depicted. As with other embodiments to be discussed, the bar 10 includes, and may consist entirely of, a soap or synthetic detergent-containing body, which includes a top surface 12 and a bottom surface 14. Each of the top and bottom surfaces 12 and 14 is a somewhat elongate surface that is sufficiently sizeable to allow the bar 10 to naturally rest horizontally thereon. The top and bottom surfaces 12 and 14 may be curved or substantially flat, although in an exemplary embodiment the top surface 12 is relatively convex, and the bottom surface 14 is relatively concave. Other variations may include convex top and bottom surfaces or concave top and bottom surfaces, while other variations may include an irregular or a corrugated top and/or bottom surface, for example. The bar 10 also includes two opposite ends 16 and 18, and first and second sides 20 and 22 extending horizontally and meeting at the first and second ends 16 and 18 to together define a perimeter around the cleansing bar 10 between the top and bottom surfaces 12 and 14. FIG. 2 is a top view of the cleansing bar 10, and FIGS. 2A, B, and C are cross-sectional views of the cleansing bar 10 taken along lines A, B, and C drawn in FIG. 2. Furthermore, FIG. 3 is a side view of the cleansing bar 10, and FIGS. 3A, B, and C are cross-sectional views of the cleaning bar 10 taken along lines A, B, and C drawn in FIG. 3. FIG. 4 is a front view of the cleansing bar 10.

A first horizontally-extending groove 24 is formed in the first side surface 20, and a second horizontally-extending groove 26 is formed in the second side surface 22. The grooves 24 and 26 are sized and positioned to receive a person's thumb on one side of the bar, and one or more fingers on the opposite side of the bar while the person holds the cleansing bar 10 and applies a laterally inward force on the bar while washing. The grooves 24 and 26 are elongate in the sense that each provides an entrenchment in the first and second side surfaces 20 and 22 that substantially extends from the center of the bar toward both of the bar ends 16 and 18. However, an exemplary bar such as that depicted in FIGS. 1 to 4 includes grooves 24 and 26 that extend only partially between the first and second ends 16 and 18. The first and second grooves 24 and 26 are concave surfaces within already concave first and second side surfaces 20 and 22. More particularly, the first and second side surfaces 20 and 22 are concave, at least in the horizontal direction extending between the first and second ends 16 and 18 to impart an hourglass shape to the overall cleansing bar 10. The first and second grooves 24 and 26 provide a region of more acute concavity to the first and second side surfaces 20 and 22. The acute concavity imparted by the first and second grooves 24 and 26 imparts at least forward and rearward lateral support to the thumb and/or fingers that are secured in the grooves 24 and 26, and preferably additional upward and downward lateral support, so a person can better grip the bar 10.

Figure 5:
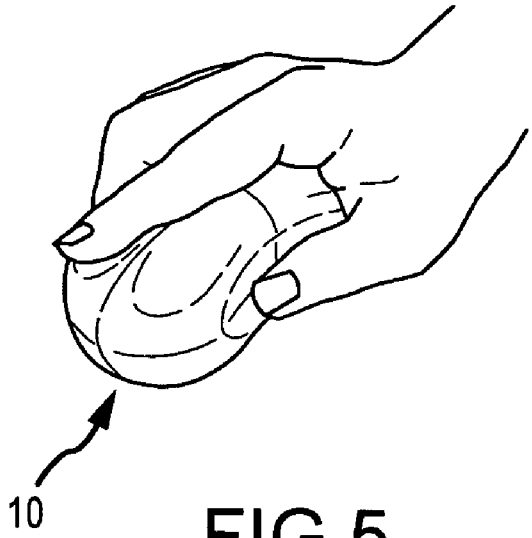
FIG. 5 is a perspective view of the cleansing bar depicted) in FIG. 1 held in an exemplary configuration in a person's hand.
Figure 6:
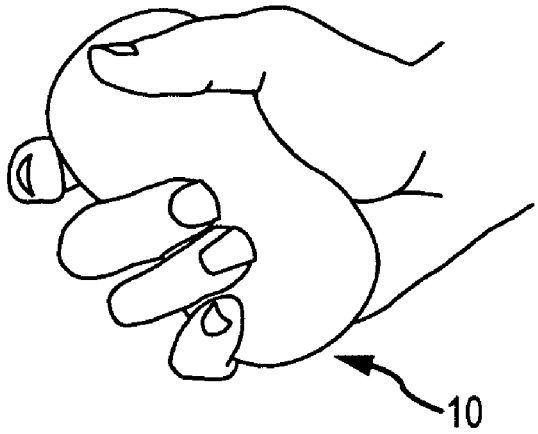
FIG. 6 is a bottom view of the cleansing bar depicted in FIG. 1 held in an exemplary configuration in a person's hand.

FIGS. 5 and 6 depict the cleansing bar 10 being held in a person's hand in two different positions. As depicted in FIG. 5, a person may naturally grip the cleansing bar 10 by placing the thumb and at least some of the fingers on opposite sides of the bar, with the thumb secured in one of the grooves 24 and 26, and at least some of the fingers secured in the opposite groove. With the fingers and thumb secured in the grooves 24 and 26, the entire bottom surface 14 is exposed as a scrubbing surface.

The top surface 12 has a first pair of substantially parallel grooves 28 and 30 entrenched therein and extending between a center region and the first end 16 of the bar. As depicted in FIG. 5, a person may use one or more of the parallel grooves 28 and 30 to secure in place one or more fingers and thereby better grip the bar 10. An upwardly rising inner lip 36 that extends between the parallel grooves may be included to provide lateral support to any of a person's fingers that are placed in the grooves 28 and 30. The inner lip 36 has a height that reaches a maximum approaching the ends 16 and 18, and dissipates as it approaches the bar center. Extending outwardly from the inner lip 38 toward the sides 20 and 22, the soap is radiused to provide concavity to the grooves 28 and 30.

A second pair of substantially parallel grooves 32 and 34 may also be entrenched in the top surface 12 and extend between the center region and the bar second end 18. According to an exemplary embodiment, the second pair of grooves 32 and 34 is formed as a mirror image of the first pair of grooves 28 and 30. Accordingly, the inner and outer lips 36 and 38 that provide lateral support to a person's finger secured in the first pair of grooves 28 and 30 will provide lateral finger support around the second pair of grooves 32 and 34.

According to an exemplary embodiment, the first and second side surfaces 20 and 22 are concave and together impart an hourglass shape to the cleansing bar 10. Turning to FIG. 6, a person's hand is depicted holding the cleansing bar in a relaxed or non-scrubbing manner. Often times, a person may want to keep the cleansing bar 10 in his or her hand in a relaxed manner before or after performing a scrubbing operation. In such a case, the hourglass shape of the bar 10 provides an ergonomic benefit since the hand can easily grip the middle section having a smaller width. At the same time, the outer sections have protruding widths with respect to the middle section, and consequently prevent the cleansing bar 10 from slipping out of the person's hand.

Figure 7:
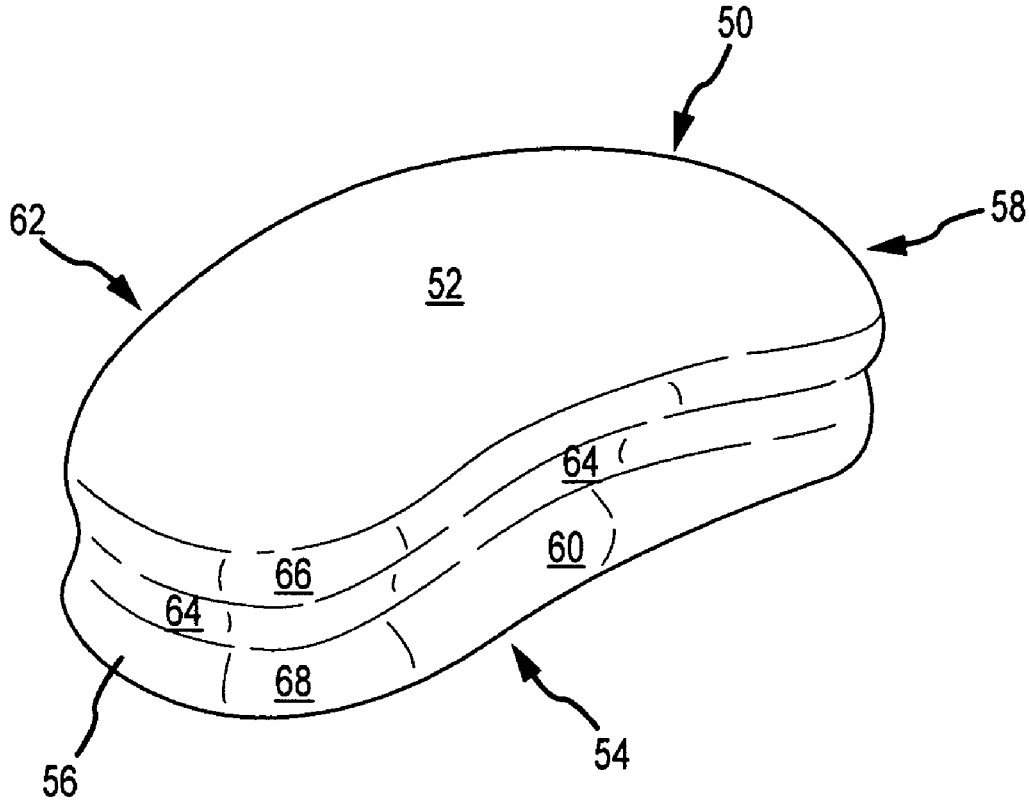
FIG. 7 is a perspective view of another exemplary cleansing bar according to an embodiment of the present invention.
Figure 8:
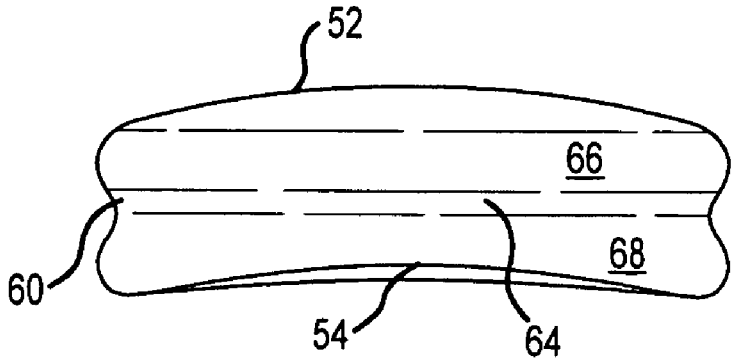
FIG. 8 is a side view of the cleansing bar depicted in FIG. 7.
Figure 9D:
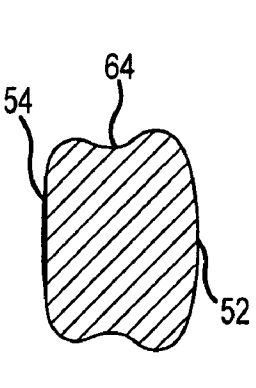
FIG. 9 is a top view of the cleansing bar depicted in FIG. 7, and FIGS. 9A, B, C, and D are cross-sectional views of the cleansing bar taken along lines A, B, C, and D drawn in FIG. 9.
Figure 9C:
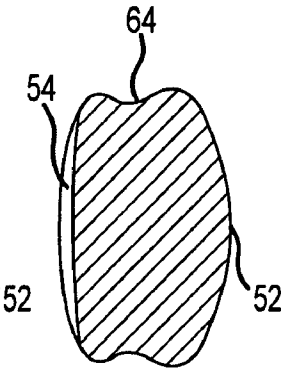
Figure 9B:
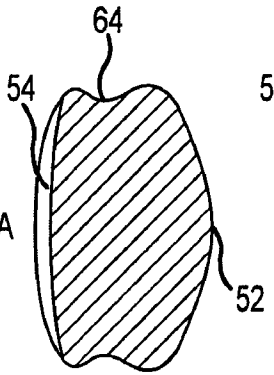
Figure 9:
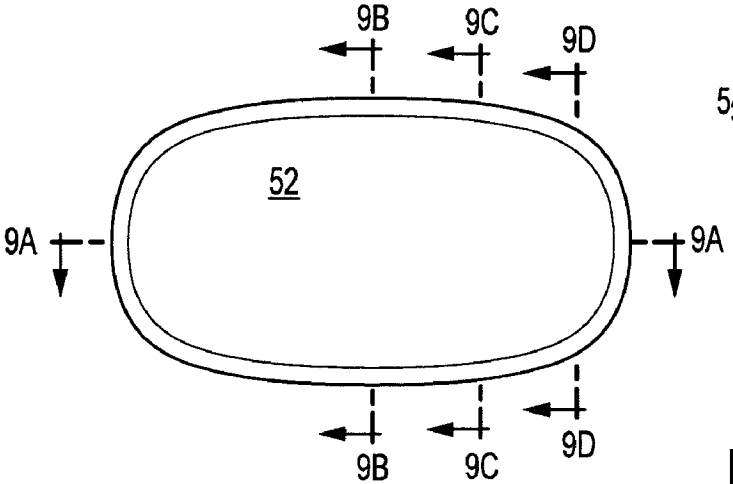
Figure 10:
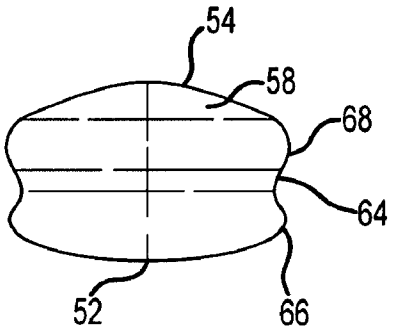
FIG. 10 is a front view of the cleansing bar depicted in FIG. 7.
Figure 9A:
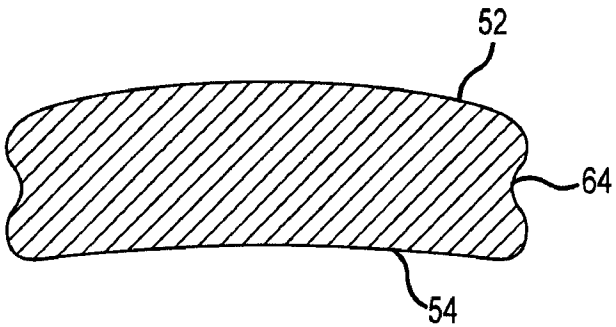

Turning now to FIG. 7, another exemplary cleansing bar 50 according to an embodiment of the present invention is depicted. The bar 10 includes, and may consist entirely of, a soap-containing body, which includes a top surface 52 and a bottom surface 54. Each of the top and bottom surfaces 52 and 54 is a somewhat elongate surface that is sufficiently sizeable to allow the bar 50 to naturally rest horizontally thereon. The top and bottom surfaces 52 and 54 may be curved or substantially flat, although in an exemplary embodiment the top surface 52 is relatively convex, and the bottom surface 54 is relatively concave. Other variations may include convex top and bottom surfaces or concave top and bottom surfaces, while other variations may include an irregular or a corrugated top and/or bottom surface, for example. The bar 50 also includes two opposite ends 56 and 58, and first and second sides 60 and 62 extending horizontally and meeting at the first and second ends 56 and 58 to together define a perimeter around the cleansing bar 50 between the top and bottom surfaces 52 and 54. FIG. 8 is a side view of the cleansing bar 50, and FIG. 10 is a front view of the cleansing bar 50. Furthermore, FIG. 9 is a top view of the cleansing bar 50, and FIGS. 9A, B, C, and D are cross-sectional views of the cleansing bar 50 taken along lines A, B, C, and D drawn in FIG. 9.

A horizontally-extending groove 64 is entrenched in the both side surfaces 60 and 62, and around the first and second ends 58 and 60 to encircle the bar 50. The groove 64 is sized and positioned to receive a person's thumb and/or fingers while the person holds the cleansing bar 50 and applies a laterally inward force on the bar while washing. On each side of the groove 64, lips 66 and 68 are provided to impart lateral support to the thumb and/or fingers that are secured in the grooves 64 so a person can better grip the bar 50. Although numerous variations may be incorporated into the bar, an exemplary bar is designed with the horizontally-extending groove 64 having a substantially uniform depth around the cleansing bar 50.

Figure 11:
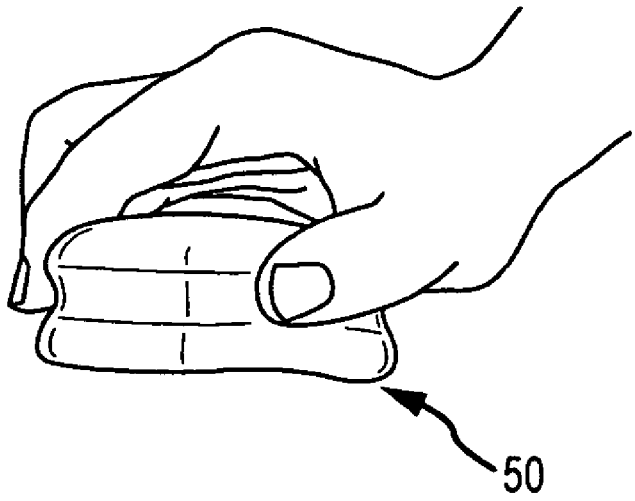
FIG. 11 is a perspective view of the cleansing bar depicted in FIG. 7 held in an exemplary configuration in a person's hand.
Figure 12:
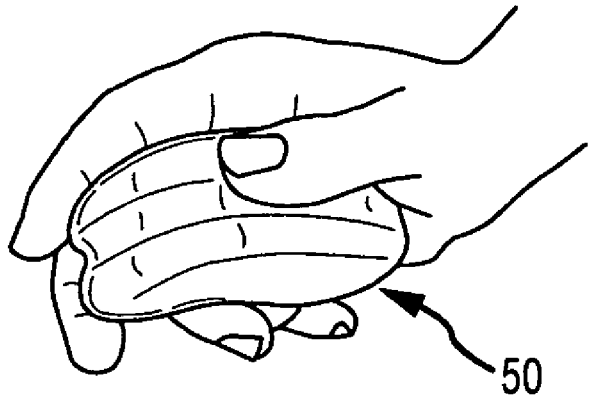
FIG. 12 is a bottom view of the cleansing bar depicted in FIG. 7 held in an exemplary configuration in a person's hand.

FIGS. 11 and 12 depict the cleansing bar 50 being held in a person's hand in two different positions. As depicted in FIG. 11, a person may naturally grip the cleansing bar 10 by placing the thumb and at least one of the fingers on opposite sides of the bar, with the thumb secured in the groove 64 on one side of the bar 50, and one or more fingers secured in the groove 64 on the opposite side of the bar 50. With the fingers and thumb secured in the groove 64, the entire bottom surface 54 is exposed as a scrubbing surface.

Turning to FIG. 12, a person's hand is depicted holding the cleansing bar 50 in a relaxed or non-scrubbing manner. As previously discussed, a person may often want to keep the cleansing bar 50 in his or her hand in a relaxed manner before or after performing a scrubbing operation. In such a case, the concave lower surface 54 and the convex upper surface 52 together provide an ergonomic benefit since one or more fingers can easily wrap around the bar with the top surface 52 pocketed in the palm of the hand, and consequently prevent the cleansing bar 10 from slipping out of the person's hand.

We claim:

1. A cleansing bar, comprising:

a surfactant-containing cleansing body that includes:

a top surface;

a bottom surface, substantially opposite to the top surface;

first and second ends;

first and second side surfaces extending horizontally and meeting at the first and second ends to together define a perimeter around the cleansing bar between the top and bottom surfaces, the first and second side surfaces being concave and together imparting an overall hourglass shape to the cleansing bar when viewed from both the top and bottom surfaces; and a first horizontally-extending groove formed in the first side surface and imparting a region of increased concavity to the concave first side surface.

2. The cleansing bar according to claim 1, wherein the top surface comprises a center region, and a first groove extending between the center region and the first end.

3. The cleansing bar according to claim 2, wherein the top surface further comprises a second groove extending between the center region and the first end, the first and second grooves together forming a first pair of substantially parallel grooves.

4. The cleansing bar according to claim 2, wherein the top surface further comprises a third groove extending between the center region and the second end.

5. The cleansing bar according to claim 3, wherein the top surface further comprises a third and fourth groove extending between the center region and the second end, the third and fourth grooves together forming a second pair of substantially parallel grooves.

6. The cleansing bar according to claim 1, wherein the first horizontally-extending groove formed in the first side surface extends only partially between the first and second ends.

7. The cleansing bar according to claim 1, further comprising a second horizontally-extending groove formed in the second side surface.

8. The cleansing bar according to claim 7, wherein the second horizontally-extending groove formed in the second side surface extends only partially between the first and second ends.

9. The cleansing bar according to claim 1, further comprising a second horizontally-extending groove formed in the second side surface and imparting a region of increased concavity to the concave second side surface.

10. A cleansing bar, comprising:

a surfactant-containing cleansing body that includes:

a top surface a bottom surface, substantially opposite to the top surface;

first and second ends first and second side surfaces extending horizontally and meeting at the first and second ends to together define a perimeter around the cleansing bar between the top and bottom surfaces; and a first horizontally-extending groove formed around the first and second ends and in the first and second side surfaces to encircle the cleansing bar.

11. The cleansing bar according to claim 10, wherein the first horizontally-extending groove has a substantially uniform depth around the cleansing bar.

* * * * *